US011843193B2

(12) United States Patent
Kitagawa

(10) Patent No.: US 11,843,193 B2
(45) Date of Patent: Dec. 12, 2023

(54) CONNECTOR AND CONNECTOR ASSEMBLY

(71) Applicant: HIROSE ELECTRIC CO., LTD., Kanagawa (JP)

(72) Inventor: Ryohei Kitagawa, Kanagawa (JP)

(73) Assignee: HIROSE ELECTRIC CO., LTD., Kanagawa (JP)

( * ) Notice: Subject to any disclaimer, the term of this patent is extended or adjusted under 35 U.S.C. 154(b) by 142 days.

(21) Appl. No.: 17/538,071

(22) Filed: Nov. 30, 2021

(65) Prior Publication Data

US 2022/0173536 A1 Jun. 2, 2022

(30) Foreign Application Priority Data

Dec. 2, 2020 (JP) ..... 2020-200524

(51) Int. Cl.
*H01R 12/71* (2011.01)
*H01R 24/60* (2011.01)
*H01R 12/70* (2011.01)

(52) U.S. Cl.
CPC ..... *H01R 12/716* (2013.01); *H01R 12/707* (2013.01); *H01R 24/60* (2013.01)

(58) Field of Classification Search
CPC .... H01R 12/716; H01R 12/707; H01R 24/60; H01R 12/91; H01R 13/502; H01R 13/629; H01R 13/631
See application file for complete search history.

(56) References Cited

U.S. PATENT DOCUMENTS 10,199,761 B1 * 2/2019 Kuo ..... H01R 12/716
2012/0003875 A1 * 1/2012 Akai ..... H01R 13/506 439/660
2014/0213115 A1 * 7/2014 Kimura ..... H01R 24/60 439/629
2015/0132999 A1 * 5/2015 Sato ..... H01R 13/6315 439/676

(Continued)

FOREIGN PATENT DOCUMENTS

JP 2019-192576 A 10/2019

*Primary Examiner* — Abdullah A Riyami
*Assistant Examiner* — Nelson R. Burgos-Guntin
(74) *Attorney, Agent, or Firm* — Rankin, Hill & Clark LLP

(57) ABSTRACT

Provided is a connector including a housing. The housing has a terminal array wall, an insertion/detachment direction restriction portion provided in an area defined by the terminal array wall and contacts the partner connector to set a maximum depth position of the partner connector upon fitting, and an inclination restriction portion. The inclination restriction portion is, at a position outside the area defined by the terminal array wall, positioned with a predetermined clearance from a corresponding portion of the partner connector at the maximum depth position upon fitting in a connector insertion/detachment direction. Upon detachment of the partner connector, when the partner connector is inclined such that a one-end-side portion of the partner connector is lifted, the other-end-side portion of the partner connector contacts the inclination restriction portion in the connector insertion/detachment direction to restrict inclination of the partner connector with an angle greater than a predetermined angle.

9 Claims, 5 Drawing Sheets

(56) References Cited

U.S. PATENT DOCUMENTS

| | | | | |
|---|---|---|---|---|
| 2015/0270658 | A1* | 9/2015 | Aoki | H01R 12/716<br>439/660 |
| 2016/0294111 | A1* | 10/2016 | Kobayashi | H01R 12/716 |
| 2018/0138618 | A1* | 5/2018 | Hasegawa | H01R 13/405 |
| 2018/0145467 | A1* | 5/2018 | Doi | H01R 12/73 |
| 2018/0337482 | A1* | 11/2018 | Teruki | H01R 13/506 |
| 2019/0013608 | A1* | 1/2019 | Yoshida | H01R 13/6315 |
| 2019/0052005 | A1* | 2/2019 | Hasegawa | H01R 13/405 |
| 2019/0334267 | A1* | 10/2019 | Hashiguchi | H01R 12/7082 |
| 2019/0334288 | A1* | 10/2019 | Horii | H01R 13/422 |
| 2019/0348782 | A1* | 11/2019 | Horii | H01R 12/727 |

* cited by examiner

CONNECTOR AND CONNECTOR ASSEMBLY

CROSS-REFERENCE TO RELATED APPLICATION

This application claims priority from Japanese Patent Application No. 2020-200524 filed with the Japan Patent Office on Dec. 2, 2020, the entire content of which is hereby incorporated by reference.

BACKGROUND

1. Technical Field

The present disclosure relates to a connector and a connector assembly.

2. Related Art

For example, a connector in a form disclosed in JP-A-2019-192576 has been known as a circuit board electrical connector attached to a circuit board, a partner connector is inserted into or detached from the connector in a connector insertion/detachment direction which is a direction perpendicular to a mounting surface of the circuit board. In JP-A-2019-192576, a second connector as the partner connector is connected to a first connector as the circuit board electrical connector. The first connector has terminals and a housing. The terminal is formed with a connection portion mounted on the mounting surface of the circuit board by soldering and a contact portion connected to the second connector. The housing extends in a longitudinal direction which is a direction parallel with the mounting surface of the circuit board, and holds the terminals arrayed in a terminal array direction which is the longitudinal direction. The housing has an island-shaped terminal array wall (an "island portion" in JP-A-2019-192576) holding the contact portions of the arrayed terminals.

The housing of the first connector has a first peripheral wall portion around the island-shaped terminal array wall, and an annular space is formed between the first peripheral wall portion and the terminal array wall. A tubular second peripheral wall portion of the second connector downwardly enters the annular space. The terminal array wall has, at the lower half of an end surface in the terminal array direction, a recessed portion formed inclined to a lower inner side in the terminal array direction. The recessed portion allows, upon detachment of the second connector, the second connector to incline such that one end side of the second peripheral wall portion of the second connector in the terminal array direction is positioned higher (a second connector detachment side) than the other end side. That is, when the second connector is inclined as described above, a lower portion of another-end-side end wall portion of the second peripheral wall portion of the second connector is housed in the recessed portion. A lower end of an end wall of the second peripheral wall portion of the second connector on the other end side contacts a bottom surface of the above-described annular space, and acts as a pivot point upon the above-described inclination.

SUMMARY

A connector according to an embodiment of the present disclosure is attached to a circuit board, a partner connector being inserted into or detached from the connector in a connector insertion/detachment direction which is a direction perpendicular to a mounting surface of the circuit board. The connector includes: a connection portion to be mounted on the mounting surface of the circuit board by soldering; a terminal formed with a contact portion to be connected to the partner connector; and a housing holding the terminal arrayed in a terminal array direction which is a direction parallel with the mounting surface of the circuit board. The housing has a terminal array wall holding the arrayed terminal, an insertion/detachment direction restriction portion provided in an area defined by the terminal array wall in the terminal array direction and configured to contact the partner connector in the connector insertion/detachment direction to set a maximum depth position of the partner connector upon fitting, and an inclination restriction portion including a one-end-side inclination restriction portion positioned at one end in the terminal array direction and another-end-side inclination restriction portion positioned on the other end, the inclination restriction portion is, at a position outside the area defined by the terminal array wall in the terminal array direction, positioned with a predetermined clearance from a corresponding portion of the partner connector at the maximum depth position upon fitting in the connector insertion/detachment direction, and upon detachment of the partner connector, when the partner connector is inclined such that a one-end-side portion of the partner connector in the terminal array direction is lifted in the connector insertion/detachment direction from the one-end-side inclination restriction portion with respect to another-end-side portion of the partner connector, the other-end-side portion of the partner connector contacts the other-end-side inclination restriction portion in the connector insertion/detachment direction to restrict inclination of the partner connector with an angle greater than a predetermined angle.

DETAILED DESCRIPTION

Figure 1:
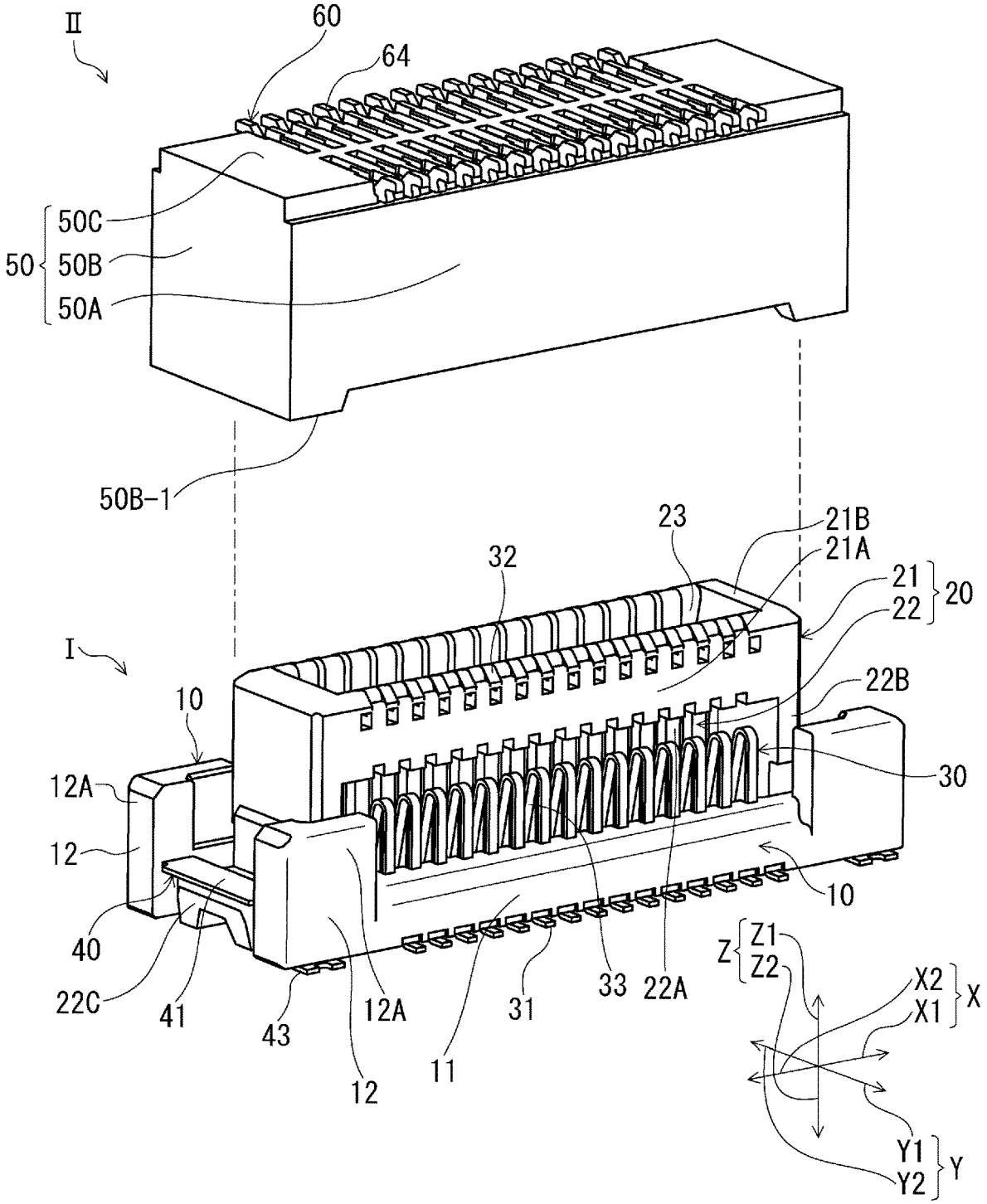
FIG. 1 is a perspective view showing an appearance before fitting of a connector and a partner connector according to an embodiment of the present disclosure.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

For the connector, size reduction in the connector longitudinal direction has been demanded. In JP-A-2019-192576, the end walls at the first peripheral wall portion of the first connector and the second peripheral wall portion of the second connector are formed thin. Upon detachment of the second connector, when the second connector inclines until contacting the recessed portion formed inclined at the terminal array wall of the first connector, great force acts on an inner surface of a lower portion of the end wall of the second connector from an end surface (an inner wall surface of the recessed portion) of the terminal array wall of the first connector in the connector longitudinal direction (the terminal array direction), i.e., an end wall thickness direction. In some cases, before the inclination angle of the second connector reaches the maximum angle, great force acts on an inner surface of the end wall of the first peripheral wall portion of the first connector from an outer surface of the end wall of the second connector in the connector longitudinal direction. Due to such force in the connector longitudinal direction, bending stress is generated at the thin end walls of the first peripheral wall portion of the first connector and the second peripheral wall portion of the second connector. As a result, there is a probability that the end walls are damaged.

The present disclosure has been made in view of the above-described situation, and an object of the present disclosure is to provide a connector and a connector assembly that reduce inclination of a partner connector with an angle greater than a predetermined angle while allowing inclination of the partner connector and reduce damage of a housing accordingly.

According to the connector and the connector assembly of the present disclosure, the above-described problems are solved.

A connector according to the present disclosure is attached to a circuit board, a partner connector being inserted into or detached from the connector in a connector insertion/detachment direction which is a direction perpendicular to a mounting surface of the circuit board. The connector includes: a connection portion to be mounted on the mounting surface of the circuit board by soldering; a terminal formed with a contact portion to be connected to the partner connector; and a housing holding the terminal arrayed in a terminal array direction which is a direction parallel with the mounting surface of the circuit board The housing has a terminal array wall holding the arrayed terminal, an insertion/detachment direction restriction portion provided in an area defined by the terminal array wall in the terminal array direction and configured to contact the partner connector in the connector insertion/detachment direction to set a maximum depth position of the partner connector upon fitting, and an inclination restriction portion including a one-end-side inclination restriction portion positioned at one end in the terminal array direction and another-end-side inclination restriction portion positioned on the other end. The inclination restriction portion is, at a position outside the area defined by the terminal array wall in the terminal array direction, positioned with a predetermined clearance from a corresponding portion of the partner connector at the maximum depth position upon fitting in the connector insertion/detachment direction, and upon detachment of the partner connector, when the partner connector is inclined such that a one-end-side portion of the partner connector in the terminal array direction is lifted in the connector insertion/detachment direction from the one-end-side inclination restriction portion with respect to another-end-side portion of the partner connector, the other-end-side portion of the partner connector contacts the other-end-side inclination restriction portion in the connector insertion/detachment direction to restrict inclination of the partner connector with an angle greater than a predetermined angle.

When the partner connector is, at a regular position and in a regular posture, fitted onto the connector having the above-described configuration, the partner connector is fitted in the direction perpendicular to the circuit board without inclination and is at the maximum depth position upon fitting, the partner connector contacting the insertion/detachment direction restriction portion at the maximum depth position. In this fitted state, the predetermined clearance is formed in the connector insertion/detachment direction between the inclination restriction portion positioned at each end of the housing in the terminal array direction of the connector, i.e., the one-end-side inclination restriction portion and the other-end-side inclination restriction portion, and the corresponding portion of the partner connector.

Upon detachment of the partner connector, the partner connector is preferably pulled up in the direction perpendicular to the circuit board. However, in many cases, the partner connector is actually detached in such a manner that the partner connector is pulled up while inclining such that the one-end-side portion of the partner connector in the terminal array direction is lifted with respect to the other-end-side portion.

When the partner connector is pulled up in the inclined posture and detached accordingly as described above, inclination of the partner connector is, in the present disclosure, allowed by the predetermined clearance between the inclination restriction portion of the connector and the corresponding portion of the partner connector in the connector insertion/detachment direction. The maximum inclination amount of the partner connector is restricted by contact of the partner connector with the inclination restriction portion. That is, upon detachment of the partner connector, when the partner connector is inclined such that the one-end-side portion of the partner connector in the terminal array direction is greatly lifted from the one-end-side inclination restriction portion in the connector insertion/detachment direction with respect to the other-end-side portion of the partner connector, the other-end-side portion of the partner connector contacts the other-end-side inclination restriction portion in the connector insertion/detachment direction, thereby restricting inclination of the partner connector with the angle greater than the predetermined angle.

A direction in which the force of contact of the partner connector with the inclination restriction portion is generated is the connector insertion/detachment direction. Normally, at an end portion of the housing, which is to be fitted in the partner connector, of the connector in the terminal array direction, a thickness in the connector insertion/detachment direction is greater than a thickness in the terminal array direction, and therefore, a strength is higher. Thus, in the present disclosure, damage of the inclination restriction portion of the housing of the connector due to the contact force in the connector insertion/detachment direction is reduced.

If the connector and the partner connector have, at the end portions thereof in the terminal array direction, portions facing each other in the terminal array direction, a clearance in the terminal array direction is set between the end portion of the connector and the end portion of the partner connector such that inclination of the partner connector with the angle greater than the predetermined angle is reduced by the inclination restriction portion, and in this manner, contact between these end portions in the terminal array direction can be avoided before the inclined end portion of the partner connector contacts the end portion of the connector in the terminal array direction.

In the present disclosure, the housing has two terminal array walls parallel with each other, two end walls connecting end portions of the two terminal array walls on both end sides, a peripheral wall formed of the two terminal array walls and the two end walls, and a receiving space for receiving the partner connector in the peripheral wall, an inner wall surface of each end wall includes such an inclined surface that a distance between the two end walls increases toward the partner connector in the connector insertion/detachment direction, and the inclined surface allows the partner connector to incline until contacting the inclination restriction portion.

Even in a case where the housing of the circuit board connector has the end walls as described above, the inclined surfaces are, at the inner wall surfaces of the end walls, formed such that the distance between these two end walls increases toward the partner connector in the connector insertion/detachment direction. Thus, until the partner connector contacts the inclination restriction portion, inclination of the partner connector is allowed by the inclined surfaces. Consequently, the end walls provided at the housing of the connector cause no problem on inclination of the partner connector.

In the present disclosure, the inclination restriction portion is preferably positioned outside the partner connector in the terminal array direction. With this configuration, when the partner connector is inclined, each of the one-end-side portion and the other-end-side portion of the partner connector is easily positioned in the area defined by the inclination restriction portion in the terminal array direction. Thus, when inclination of the partner connector becomes greater, inclination of the partner connector can be favorably restricted by the inclination restriction portion.

In the present disclosure, the inclination restriction portion may be formed at a metal fitting as a member attached to the housing. The inclination restriction portion is formed at the metal fitting as described above so that the strength of the inclination restriction portion can be increased as compared to the case of forming the inclination restriction portion at resin as a general housing material and inclination of the partner connector can be more favorably restricted.

A connector assembly according to the present disclosure includes: the connector described above; and a partner connector fittably connected to the connector, in which the partner connector has an inclination restriction target portion facing the inclination restriction portion of the connector in a connector insertion/detachment direction.

According to the present disclosure, when the partner connector is pulled in the inclined posture and detached accordingly, inclination of the partner connector is allowed by the clearance in the connector insertion/detachment direction between the partner connector and the inclination restriction portion of the connector. The maximum inclination amount of the partner connector is restricted by contact of the partner connector with the inclination restriction portion. That is, the direction in which the force of contact of the partner connector with the inclination restriction portion is generated is the connector insertion/detachment direction. In the circuit board electrical connector, the end portion of the housing, which is to be fitted in the partner connector, in the terminal array direction normally has a greater thickness in the connector insertion/detachment direction than the thickness in the terminal array direction, and therefore, has a high strength. Thus, in the present disclosure, damage of the inclination restriction portion of the housing due to the contact force in the connector insertion/detachment direction is reduced.

Hereinafter, an embodiment of the present disclosure will be described based on the drawings.

Figure 2:
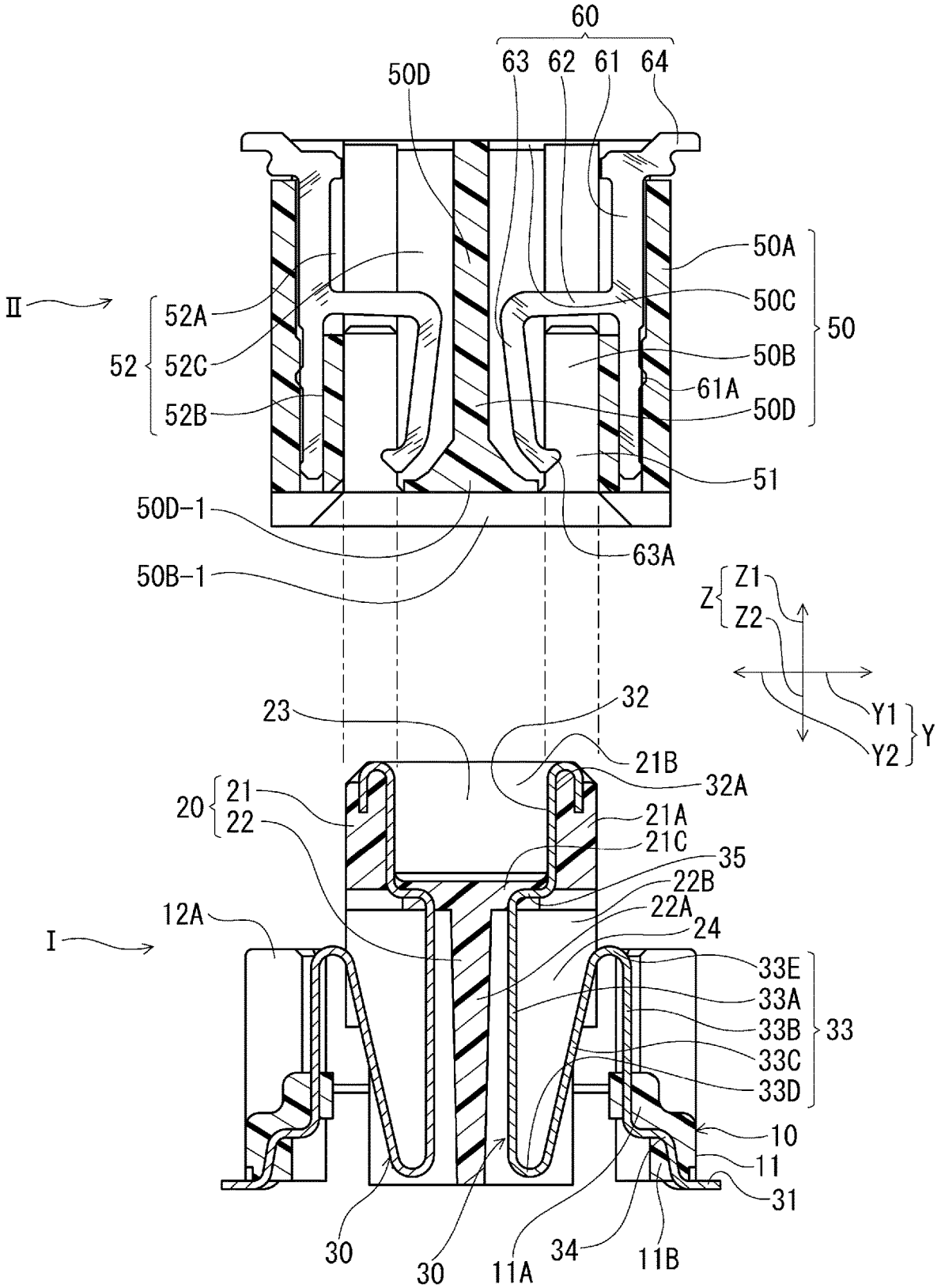
FIG. 2 is a sectional view of the connector and the partner connector of FIG. 1 along a Y-Z plane, FIG. 2 being a longitudinal sectional view at a terminal position.
Figure 3B:
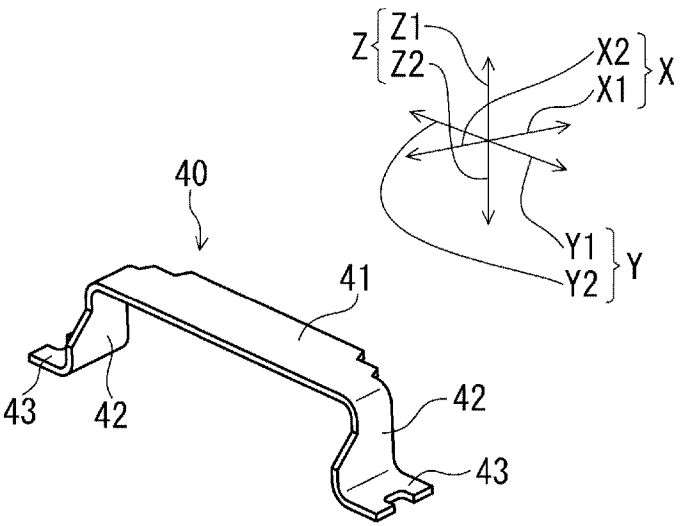
FIG. 3B is a perspective view showing a coupling member in the connector of FIG. 1.
Figure 3A:
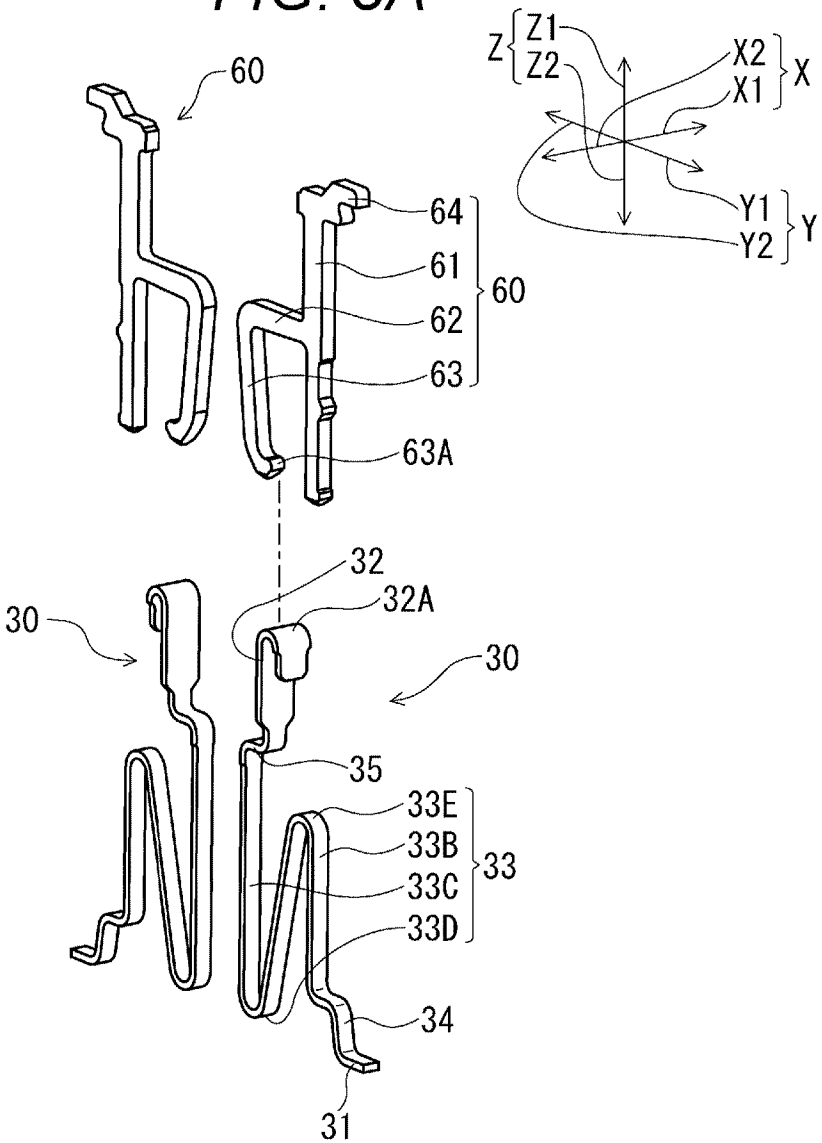
FIG. 3A is a perspective view showing ones of multiple pairs of terminals of the connector and the partner connector of FIG. 1.

FIG. 1 is a perspective view showing an appearance before fitting of a connector I and a partner connector II of the present embodiment. FIG. 2 is a sectional view of the connector I and the partner connector II of FIG. 1 along a Y-Z plane, FIG. 2 being a longitudinal sectional view at a terminal position. FIG. 3A is a perspective view showing ones of multiple pairs of terminals of the connector I and the partner connector II of FIG. 1. FIG. 3B is a perspective view showing a coupling member for the connector of FIG. 1.

In FIG. 1, the connector I and the partner connector II are circuit board electrical connectors attached to different circuit boards (not shown), and are fittably connected to each other in a state in which the surfaces of the different circuit boards are parallel with each other. In the present embodiment, the connector I is configured as a so-called receptacle connector having female terminals (later-described terminals 30). The partner connector II is configured as a so-called plug connector having male terminals (later-described partner terminals 60). In the present embodiment, for the sake of simplicity in description of orientation, a terminal array direction (hereinafter referred to as a terminal array direction) parallel with the surface of the circuit board is X (one side is X1, and the other side is X2), a connector width direction (hereinafter referred to as a connector width direction) parallel with the surface of the circuit board and perpendicular to the terminal array direction X is Y (one side is Y1, and the other side is Y2), and an upper-lower direction (hereinafter referred to as an upper-lower direction) perpendicular to both of X and Y is Z (the upper side is Z1, and the lower side is Z2).

The partner connector II is fittably connected to the connector I attached onto the circuit board (not shown). A connector insertion/detachment direction is the upper-lower direction Z, and the partner connector II is fittably connected to the connector I from the upper Z1 side to the lower Z2 side.

Hereinafter, the configurations of the connector I and the partner connector II will be sequentially described.

As shown in FIGS. 1 and 2, the connector I of the present embodiment has a housing (fixed housings 10 and a movable housing 20 as described later) made of an electrical insulating material such as resin, the metal terminals 30, and metal coupling members 40. The connector I has, as a whole, a substantially rectangular parallelepiped outer shape of which longitudinal direction is the terminal array direction X, and is arranged on the circuit board (not shown). The terminals 30 and the coupling members 40 are each connected to corresponding locations of the circuit board by soldering. In the present embodiment, the connector I is formed symmetrically in any of the terminal array direction X and the connector width direction Y.

The housing has the two fixed housings 10 fixed to the circuit board through the terminals 30 and the coupling members 40 and the movable housing 20 movable relative to the fixed housings 10. The fixed housings 10 and the movable housing 20 are formed as separate members. The fixed housings 10 are, one by one, provided on both sides of the movable housing 20 in the connector width direction Y, i.e., the Y1 side and the Y2 side. These two fixed housings 10 are separate members, and are positioned apart from the movable housing 20 in the connector width direction Y and extend in the terminal array direction X.

As shown in FIG. 1, each of the two fixed housings 10 has an intermediate portion 11 and coupling target portions 12. The intermediate portion 11 is in a rod shape, and extends in the terminal array direction X across an area where the terminals 30 are arrayed. The coupling target portions 12 are positioned on both sides of the intermediate portion 11 in the terminal array direction X, and are formed higher than the intermediate portion 11 in the upper-lower direction Z. That is, each coupling target portion 12 forms an end portion of the fixed housing 10 in the terminal array direction X, and an upper surface of the coupling target portion 12 is positioned higher than an upper surface of the intermediate portion 11.

As shown in FIG. 2, the section (the Y-Z plane) of the intermediate portion 11 perpendicular to the terminal array direction X is in a substantially crank shape. The intermediate portion 11 is in such a shape that an upper portion 11A positioned inside in the connector width direction Y and protruding toward the upper Z1 side and a lower portion 11B positioned outside in the connector width direction Y and protruding toward the lower Z2 side are connected to each other. The upper portion 11A and the lower portion 11B of the intermediate portion 11 form a fixed-side holding portion for holding, by integral molding (insert molding), later-described fixed-side coupling portions 34 forming one-end-side portions (lower-end-side portions in FIG. 2) of the terminals 30.

The coupling target portion 12 has a greater dimension in the upper-lower direction Z than a dimension in the terminal array direction X. An upper portion of the coupling target portion 12 forms an inclination restriction portion 12A for restricting inclination of the partner connector II with an angle greater than a predetermined angle. As described later, upon detachment of the partner connector II, when the partner connector II inclines while rotating about a Y-axis extending in the connector width direction Y, flat upper surfaces of the inclination restriction portions 12A contact the partner connector II, and accordingly, the inclination restriction portions 12A restrict inclination of the partner connector II with the angle greater than the predetermined angle (see FIGS. 4 and 5B). In a connector fitted state (see FIG. 5A) at a regular fitting position, the coupling target portions 12 and therefore the inclination restriction portions 12A are positioned outside outer end surfaces (surfaces perpendicular to the terminal array direction X) of end walls 50B of the partner connector II in the terminal array direction X. In the present embodiment, the inclination restriction portion 12A positioned on the X1 side in the terminal array direction X will be referred to as a "one-end-side inclination restriction portion 12A" and the inclination restriction portion 12A positioned on the X2 side will be referred to as the "other-end-side inclination restriction portion 12A," as necessary. In a case where it is not necessary to distinguish both of these portions from each other, these portions will be merely collectively referred to as "inclination restriction portions 12A" in some cases.

As shown in FIGS. 1 and 2, the movable housing 20 has a fitting portion 21 forming an upper half portion and a support rod portion 22 forming a lower half portion.

As shown in FIG. 1, the fitting portion 21 is in a bottomed rectangular tubular shape opening on the upper Z1 side. The fitting portion 21 has side walls 21A as two terminal array walls extending in the terminal array direction X, two end walls 21B extending in the connector width direction Y and connecting end portions of the two side walls 21A on both end sides, and a bottom wall 21C (see FIG. 2) closing a lower portion of a peripheral wall formed by the two side walls 21A and the two end walls 21B. As shown in FIG. 2, the fitting portion 21 holds the terminals 30 by the side walls 21A (the terminal array walls) and the bottom wall 21C. A space opening upwardly and surrounded by the peripheral wall formed by the two side walls 21A and the two end walls 21B and the bottom wall 21C forms a receiving space 23 for receiving a corresponding portion (a later-described center wall 50D) of the partner connector II from the upper Z1 side. The coupling target portions 12 including the inclination restriction portions 12A are, in the terminal array direction X, positioned outside an area defined by the side walls 21A as the terminal array walls (i.e., positioned outside).

Figure 5A:
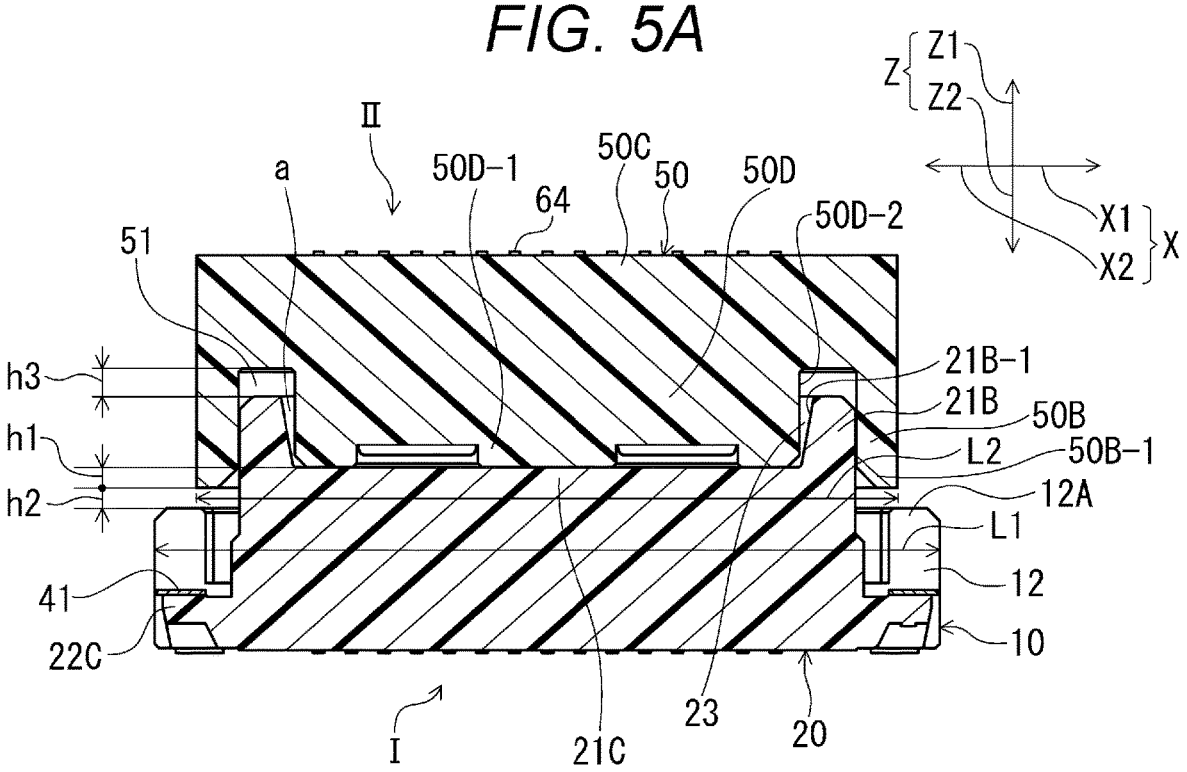
FIGS. 5A and 5B are sectional views of the connector and the partner connector of FIG. 1 along an X-Z plane, FIG. 5A showing a fitted state when the partner connector is at a regular position and FIG. 5B showing a state equivalent to FIG. 4 in the course of detaching the partner connector in the inclined posture.

As shown in FIG. 5A, inner surfaces of the end walls 21B are inclined outwardly in the terminal array direction X toward the upper Z1 side. The inner surface of the end wall 21B forms such an inclined surface 21B-1 that a distance (a distance in the terminal array direction X) between the inner surfaces of the end walls 21B positioned on both sides of the fixed housing 10 increases toward the upper Z1 side. The inclined surfaces 21B-1 of the end walls 21B allow, as described later, the partner connector II to incline until contacting the inclination restriction portions 12A of the fixed housings 10.

The bottom wall 21C is positioned across the same area as that defined by the side walls 21A in the terminal array direction X, and an upper surface thereof forms a flat surface. Upon connector fitting, the partner connector II contacts the bottom wall 21C from the upper Z1 side in the upper-lower direction Z. The bottom wall 21C functions as an insertion/detachment direction restriction portion for setting the maximum depth position of the partner connector II upon fitting. Specifically, when the partner connector II is fitted onto the connector I without inclining with respect to the upper-lower direction Z and the later-described center wall 50D of the partner connector II is fitted in the receiving space 23 from above, a lower end surface of the center wall 50D contacts the upper surface of the bottom wall 21C, and accordingly, the maximum depth position of the partner connector II upon fitting is set.

The support rod portion 22 has a vertical center wall portion 22A and vertical end wall portions 22B extending from a lower surface of the bottom wall 21C to the lower Z2 side and movable restriction target portions 22C extending outwardly from lower end portions of the vertical end wall portions 22B in the terminal array direction X. Lower ends of the vertical center wall portion 22A and the vertical end wall portions 22B of the support rod portion 22 are positioned in the vicinity of the surface of the circuit board (not shown), but are not fixed to the circuit board. Thus, when the terminals 30 receive external force, the entirety of the movable housing 20 is movable in the terminal array direction X, the connector width direction Y, and the upper-lower direction Z due to elastic deformation of the terminals 30.

The vertical center wall portion 22A is positioned at the center of the bottom wall 21C in the connector width direction Y, and extends from the lower surface of the bottom wall 21C to the lower Z2 side and extends in the terminal array direction X across the entire length of the receiving space 23. The vertical end wall portions 22B are provided integrally with the vertical center wall portion 22A at the same positions as those of the end walls 21B of the fitting portion 21 in the terminal array direction X, in other words, the positions of both ends of the vertical center wall portion 22A in the terminal array direction X, and extend in the connector width direction Y across the same area as that defined by the end walls 21B.

The movable restriction target portion 22C extends outwardly from the lower end portion of the vertical end wall portion 22B in the terminal array direction X as already described, and as shown in FIGS. 1 and 5A, is positioned below a later-described intermediate bridging portion 41 of the coupling member 40. The movable restriction target portion 22C faces the intermediate bridging portion 41 such that an upper surface thereof contacts a lower surface of the intermediate bridging portion 41 (see FIG. 5A). As a result, movement of the movable housing 20 to the upper Z1 side is restricted by contact of the movable restriction target portions 22C with the intermediate bridging portions 41 from below. Alternatively, the movable restriction target portion 22C may be positioned with a predetermined clearance in the upper-lower direction Z without contacting the intermediate bridging portion 41. In this case, movement of the movable housing 20 to the upper Z1 side is allowed only by the dimension of such a predetermined clearance.

As shown in FIG. 2, a space surrounded by the bottom wall 21C, the vertical center wall portion 22A, and the vertical end wall portions 22B opens to the outside in the connector width direction Y on the lower Z2 side, and forms a laterally-opening space 24 for housing an inner linear portion 33A and an intermediate linear portion 33C of each terminal 30 as described later.

As shown in FIGS. 2 and 3A, the terminal 30 is formed in such a manner that a metal flat band-shaped piece is bent in a plate thickness direction thereof, and as a terminal width, has the width of the metal flat band-shaped piece in a direction perpendicular to the plate thickness direction. As shown in FIG. 3A, the terminal width of a later-described contact portion 32 of the terminal 30 is slightly greater than those of other portions of the terminal 30, and these terminal widths of the other portions are substantially equal across the entire length of the terminal 30. As shown in FIG. 2, when the connector I is viewed from the terminal array direction X, the terminal 30 has a connection portion 31 formed at one end portion positioned on the lower Z2 side, the contact portion 32 formed at the other end portion positioned on the upper Z1 side, an elastic portion 33 extending in a substantially lying S-shape between the connection portion 31 and the contact portion 32, the fixed-side coupling portion 34 coupling the connection portion 31 and the elastic portion 33 to each other, and a movable-side coupling portion 35 coupling the contact portion 32 and the elastic portion 33 to each other (also see FIG. 3A). The terminals 30 are provided in pairs symmetrically in the connector width direction Y, and the multiple pairs of terminals 30 are arrayed in the terminal array direction X.

As shown in FIG. 2, the connection portion 31 protrudes from a bottom surface of the intermediate portion 11 of the fixed housing 10, and extends outwardly in the connector width direction Y along such a bottom surface. The connection portion 31 is, by soldering, connected to a corresponding circuit portion of the circuit board in a state in which the connector I is arranged on an upper surface of the circuit board (not shown). The fixed-side coupling portion 34 extends from an inner end of the connection portion 31 in the connector width direction Y to bend to the upper Z1 side in a crank shape. The fixed-side coupling portion 34 is, by integral molding, held at the intermediate portion 11 of the fixed housing 10. Part of a lower surface of the fixed-side coupling portion 34 corresponding to a location supported by a die upon integral molding is exposed.

As shown in FIG. 2, the contact portion 32 linearly extends along an inner surface of the side wall 21A of the movable housing 20. An upper end portion of the contact portion 32 forms an inverted U-shaped upper end curved portion 32A bent outwardly in the connector width direction Y. A tip end portion of the upper end curved portion 32A is fully embedded in the side wall 21A, and a portion of the upper end curved portion 32A other than the tip end portion is embedded in the side wall 21A in a state in which only an upper surface of such a portion is exposed. An upper surface of the upper end curved portion 32A, specifically an upper surface exposed to the inside in the connector width direction Y, is exposed to such an extent that such an upper surface slightly protrudes from an upper surface of the side wall 21A, and forms the substantially same surface as that of the side wall 21A to form an insertion guiding surface for the partner connector II.

A linear portion of the contact portion 32, i.e., a portion extending along the inner surface of the side wall 21A, is embedded in the side wall 21A in a state in which only an inner surface of the linear portion facing a receiving space 23 side is exposed. The inner surface of the linear portion of the contact portion 32 is exposed with the linear portion slightly protruding from the inner surface of the side wall 21A, and forms a contact surface which is to contact the partner terminal 60 of the partner connector II.

The movable-side coupling portion 35 extends from a lower end of the contact portion 32 to bend to the lower Z2 side in a crank shape, and by integral molding, is held at the bottom wall 21C of the movable housing 20. Part of a lower surface of the movable-side coupling portion 35 corresponding to a location supported by the die upon integral molding is exposed.

As shown in FIG. 2, the elastic portion 33 is in a shape bent in a substantially lying S-shape when viewed from the terminal array direction X, and couples an upper end of the fixed-side coupling portion 34 and a lower end of the movable-side coupling portion 35 to each other. The elastic portion 33 has the inner linear portion 33A positioned inside in the connector width direction Y, an outer linear portion 33B positioned outside in the connector width direction Y, the intermediate linear portion 33C positioned in the middle between the inner linear portion 33A and the outer linear portion 33B, a lower end curved portion 33D coupling lower ends of the inner linear portion 33A and the intermediate linear portion 33C to each other, and an upper end curved portion 33E coupling upper ends of the intermediate linear portion 33C and the outer linear portion 33B.

The elastic portion 33 in such a shape can be elastically displaced (elastically deformed) as a whole in the terminal array direction X, the connector width direction Y, and the upper-lower direction Z when the terminal 30 receives external force. Thus, when the movable housing 20 is fitted into the partner connector II, if the movable housing 20 is positioned shifted from the fixed housings 10, e.g., shifted from the regular fitting position in the connector width direction Y, such shift is absorbed by elastic displacement of the elastic portions 33 in the connector width direction Y and so-called floating is performed. In this state, in a case where the position shift of the movable housing 20 is to, e.g., the Y1 side, the elastic portions 33 of the terminals 30 positioned on the Y1 side are elastically displaced and compressed in the connector width direction Y, and the elastic portions 33 of the terminals 30 positioned on the Y2 side are elastically displaced and expanded in the connector width direction Y.

As shown in FIG. 3B, the coupling member 40 is in such a form that a metal band-shaped member is bent in a plate thickness direction thereof. Shown in FIG. 3B is one, which is positioned on the X1 side in the terminal array direction X, of the two coupling members 40 provided at the connector I. The coupling member 40 positioned on the X2 side is provided in a posture symmetrical to the coupling member 40 shown in FIG. 3B in the terminal array direction X.

The coupling members 40 are provided outside a lower portion of the movable housing 20 in the terminal array direction X. The coupling member 40 has the intermediate bridging portion 41, holding target portions 42, and fixing target portions 43. The intermediate bridging portion 41 extends in the connector width direction Yin parallel with the surface of the circuit board. The holding target portions 42 form a leg shape bent at both ends of the intermediate bridging portion 41 in the connector width direction Y and extending to the lower Z2 side. The fixing target portions 43 are bent at lower ends of the holding target portions 42, and extend outwardly in the connector width direction Y.

The intermediate bridging portion 41 is provided in such a posture that a plate thickness direction thereof is in the upper-lower direction Z, and extends in the connector width direction Y in an area between the coupling target portions 12 of the two fixed housings 10. Moreover, the intermediate bridging portion 41 is, right above the movable restriction target portion 22C of the movable housing 20, positioned contactable with the movable restriction target portion 22C from above. Thus, the intermediate bridging portion 41 has the function of a restriction portion for restricting movement of the movable restriction target portion 22C and therefore the movable housing 20 to the upper Z1 side.

The holding target portions 42 are, by integral molding, embedded and held in the coupling target portions 12 of the fixed housings 10. The fixing target portion 43 extends along a bottom surface of the coupling target portion 12 of the fixed housing 10, and an end portion of the fixing target portion 43 protrudes from the bottom surface of the coupling target portion 12. The fixing target portions 43 are, by soldering, fixed to corresponding locations of the circuit board in a state in which the connector I is arranged on the upper surface of the circuit board (not shown).

The coupling members 40 are held by the coupling target portions 12 of the two fixed housings 10, and accordingly, these two fixed housings 10 are coupled to each other by the coupling members 40. In the present embodiment, when the connector I is viewed from the upper-lower direction Z, the two fixed housings 10 and the two coupling members 40 form a rectangular frame shape surrounding the lower portion of the movable housing 20. Advantages of coupling of the two fixed housings 10, which are positioned separately, by means of the coupling members 40 include not only stronger fixation of the two fixed housings 10 to the circuit board, but also reduction in the size of the connector I in the terminal array direction X and easier manufacturing of the fixed housing 10. Further, the advantages include a higher strength and a higher capacity of restricting movement of the movable housing 20 because of the metal coupling members 40 when the intermediate bridging portions 41 of the coupling members 40 function as the restriction portions for restricting movement of the movable housing 20 to the upper Z1 side as already described.

As shown in FIG. 1, the partner connector II has a partner housing 50 made of an electrical insulating material such as resin and the partner terminals 60 held by the partner housing 50 and formed of metal plates. FIG. 1 shows the partner connector II in a posture when the partner connector II is fittably connected to the connector I toward the lower Z2 side, and shows a bottom side of the partner connector II attached to the circuit board (not shown). Thus, a fitting side of the partner connector II is not shown in FIG. 1.

As shown in FIG. 1, the partner housing 50 has, as a whole, a rectangular parallelepiped outer shape of which longitudinal direction is the terminal array direction X. The partner housing 50 has two side walls 50A extending in the terminal array direction X, the two end walls 50B extending in the connector width direction Y and connecting end portions of the two side walls 50A on both end sides, a bottom wall 50C (FIG. 1) closing an upper portion of a peripheral wall formed by the two side walls 50A and the two end walls 50B, and the center wall 50D (see FIGS. 2, 5A, and 5B) extending from the bottom wall 50C to the lower Z2 side in the peripheral wall. The center wall 50D is positioned at the center in the connector width direction Y, and is in a plate shape extending in the terminal array direction X. An annular space surrounded by the peripheral wall, the bottom wall 50C, and the center wall 50D and opening on the lower Z2 side in FIG. 1 forms a partner-side receiving space 51 for receiving the peripheral wall of the fitting portion 21 of the connector I from below (see FIGS. 2, 5A, and 5B).

The end wall 50B has a greater dimension in the upper-lower direction Z than a dimension in the terminal array direction X. As shown in FIG. 1, a lower end of the end wall 50B protrudes to the lower Z2 side with respect to a lower end of the side wall 50A, and forms an inclination restriction target portion 50B-1 (also see FIGS. 5A and 5B). As described later, upon connector detachment, if the partner connector II is inclined with respect to the upper-lower direction Z, i.e., the partner connector II is inclined in the direction of rotation about the axis along the connector width direction Y, the inclination restriction target portions 50B-1 contact upper surfaces of the inclination restriction portions 12A of the connector I from the upper Z1 side, and accordingly, inclination of the partner connector II with the angle greater than the predetermined angle is restricted (see FIGS. 4 and 5B). In the present embodiment, the inclination restriction target portion 50B-1 positioned on the X1 side in the terminal array direction X will be referred to as a "one-end-side inclination restriction target portion 50B-1" and the inclination restriction target portion 50B-1 positioned on the X2 side will be referred to as the "other-end-side inclination restriction target portion 50B-1," as necessary. In a case where it is not necessary to distinguish both of these portions from each other, these portions will be merely collectively referred to as "inclination restriction target portions 50B-1" in some cases.

A lower end portion of the center wall 50D forms an insertion/detachment direction restriction target portion 50D-1. As shown in FIG. 5A, the insertion/detachment direction restriction target portion 50D-1 contacts the bottom wall 21C as the insertion/detachment direction restriction portion of the connector I when the partner connector II is fitted to the regular fitting position with respect to the connector I toward the lower Z2 side without inclining with respect to the upper-lower direction Z. As a result, a lower surface of the insertion/detachment direction restriction target portion 50D-1 contacts the upper surface of the bottom wall 21C, and the maximum depth position of the partner connector II upon fitting is set.

When the partner housing 50 is at the regular fitting position (see FIG. 5A) with respect to the connector I, the partner housing 50 has the following dimensional relationships (1) to (3) with the housing of the connector I in the terminal array direction X and the upper-lower direction Z.

(1) As shown in FIG. 5A, a distance L2 between outer surfaces of the end walls 50B of the partner housing 50 of the partner connector II on both sides in the terminal array direction X is shorter than a distance L1 between outer ends of both coupling target portions 12 of the fixed housing 10 of the connector I in the terminal array direction X. Thus, the end walls 50B of the partner housing 50 are within an area defined by the coupling target portions 12 in the terminal array direction X. That is, in the terminal array direction X, the inclination restriction target portions 50B-1 forming lower end portions of the end walls 50B are within an area defined by the inclination restriction portions 12A forming the upper portions of the coupling target portions 12.

(2) As shown in FIG. 5A, the end wall 50B of the partner housing 50 of the partner connector II protrudes to the lower Z2 side by a distance h1 beyond the insertion/detachment direction restriction target portion 50D-1 of the center wall 50D. In other words, the insertion/detachment direction restriction target portion 50D-1 is recessed to the upper Z1 side by the distance h1 with respect to the lower end of the end wall 50B. A clearance h2 is, in the upper-lower direction Z, formed between the inclination restriction target portion 50B-1 of the end wall 50B and the inclination restriction portion 12A of the coupling target portion 12 of the fixed housing 10 of the connector I.

(3) A clearance h3 is, in the upper-lower direction Z, formed between a bottom surface (the upper surface in FIG. 5A) of the partner-side receiving space 51 of the partner housing 50 of the partner connector II and the end wall 21B of the movable housing 20 of the connector I.

As shown in FIG. 2, a terminal groove 52 for housing the later-described partner terminals 60 is formed at the partner housing 50. As described later, the partner terminal 60 is formed in such a manner that a metal plate is punched out in a plate thickness direction thereof, and is housed in the terminal groove 52 in such a posture that a plate surface of the metal plate is parallel with the plane (the Y-Z plane) of paper of FIG. 2.

As shown in FIG. 2, the terminal groove 52 has an outer housing groove 52A, a press-fitting groove 52B, and an inner housing groove 52C. The outer housing groove 52A is formed opened on the inside in the connector width direction Y and the upper Z1 side in an area from the intermediate position of the side wall 50A to a bottom surface (the upper surface in FIG. 2) of the bottom wall 50C in the upper-lower direction Z. The press-fitting groove 52B is, on the lower Z2 side with respect to the outer housing groove 52A in FIG. 2, formed as a hole penetrating the side wall 50A in the upper-lower direction Z. The inner housing groove 52C is formed opened on the outside in the connector width direction Y and the upper Z1 side in an area from a position close to a lower end of the center wall 50D to the bottom surface (the upper surface in FIG. 2) of the bottom wall 50C in the upper-lower direction Z. The terminal groove 52 has, in a direction (the terminal array direction X) perpendicular to the plane of paper of FIG. 2, a groove width substantially equal to the plate thickness of the partner terminal 60.

As already described, the partner terminal 60 is formed in such a manner that the metal plate is punched out in the plate thickness direction (the direction perpendicular to the plate surface) while the flat plate surface of the metal plate is maintained (also see FIG. 3). As shown in FIG. 2, the partner terminal 60 has a linear fixed arm portion 61 extending in the upper-lower direction Z, an extending arm portion 62 extending, in the connector width direction Y, inwardly from the intermediate position of the fixed arm portion 61 in the upper-lower direction Z, a contact arm portion 63 bent from the extending arm portion 62 to extend toward the lower Z2 side, and a connection portion 64 extending outwardly from an upper end portion of the fixed arm portion 61 in the connector width direction Y.

Of the fixed arm portion 61, an upper half portion is housed in the outer housing groove 52A and a lower half portion is held in the press-fitting groove 52B by press-fitting, as shown in FIG. 2. A press-fitting protrusion 61A is formed at the side edge of the lower half portion of the fixed arm portion 61. When the lower half portion of the fixed arm portion 61 is press-fitted to a predetermined position in the press-fitting groove 52B from above, the press-fitting protrusion 61A bites into an inner wall surface of the press-fitting groove 52B, and accordingly, the fixed arm portion 61 is fixed. As a result, detachment of the partner terminal 60 is reduced.

The contact arm portion 63 is, excluding a later-described contact portion 63A, housed in the inner housing groove 52C. In the present embodiment, the contact arm portion 63 is positioned with a slight clearance from an inner wall surface of the inner housing groove 52C in a plate thickness direction (the terminal array direction X) of the contact arm portion 63, and elastic displacement of the contact arm portion 63 in the connector width direction Y is allowed. At a lower end portion of the contact arm portion 63, the contact portion 63A protruding outwardly in the connector width direction Y and positioned in the partner-side receiving space 51 is provided. The contact portion 63A is a portion for contacting the contact portion 32 of the terminal 30 of the connector I as already described, and a protruding top surface (a plate thickness surface) of the contact portion 63A is contactable with a plate surface of the contact portion 32 in a state in which the contact arm portion 63 is elastically displaced. In a state in which the partner connector II is arranged on the circuit board (not shown), the upper edge of the connection portion 64 as shown in FIG. 2 is, by soldering, connected to a corresponding circuit portion of the circuit board.

The connector I and the partner connector II of the present embodiment are, upon use, inserted into or detached from each other as follows.

First, the connector I and the partner connector II are each mounted on the corresponding circuit boards (not shown). Specifically, the connector I is mounted in such a manner that the connection portions 31 of the terminals 30 are, by soldering, connected to the corresponding circuit portions of the circuit board and the fixing target portions 43 of the coupling members 40 are, by soldering, fixed to the corresponding locations of the circuit board. Meanwhile, the partner connector II is mounted in such a manner that the connection portions 64 of the partner terminals 60 are, by soldering, connected to the corresponding circuit portions of another circuit board.

Next, as shown in FIGS. 1 and 2, the partner connector II is, above the connector I, positioned in such a posture that the partner-side receiving space 51 (see FIG. 2) opens on the lower Z2 side, and is brought into a state right before fitting. Thereafter, the partner connector II is lowered without inclining with respect to the upper-lower direction Z. By lowering of the partner connector II, the center wall 50D of the partner connector II enters the receiving space 23 of the fitting portion 21 of the connector I from above, and the fitting portion 21 of the connector I enters the partner-side receiving space 51 of the partner connector II from below. Accordingly, the connector I and the partner connector II are brought into the fitted state in which the connector I and the partner connector II are inserted into each other to the regular fitting position shown in FIG. 5A.

At the regular fitting position, the lower end portion of the center wall 50D of the partner connector II, i.e., the lower surface of the insertion/detachment direction restriction target portion 50D-1, contacts the insertion/detachment direction restriction portion of the fitting portion 21 of the connector I, i.e., the upper surface of the bottom wall 21C. Accordingly, the position of the partner connector II is set to the maximum depth position upon fitting (see FIG. 5A). At the regular fitting position, the partner connector II and the connector I contact each other in the upper-lower direction Z only at the insertion/detachment direction restriction target portion 50D-1 of the partner connector II and the bottom wall 21C as the insertion/detachment direction restriction portion of the connector I as shown in FIG. 5A, and do not contact each other at other locations. In this state, as shown in FIG. 5A, the clearance h3 in the upper-lower direction Z is formed between the bottom wall 50C of the partner connector II and the end wall 21B of the connector I, and the clearance h2 in the upper-lower direction Z is formed between the inclination restriction target portion 50B-1 of the end wall 50B of the partner connector II and the inclination restriction portion 12A of the connector I.

The connector I and the partner connector II as described above are, at the regular fitting position, electrically connected to each other in such a manner that the contact portions 63A of the partner terminals 60 of the partner connector II contact, with pressure, the contact portions 32 of the terminals 30 of the connector I with the contact arm portions 63 being elastically displaced.

Fitting of the partner connector II onto the connector I is not always started at a position corresponding to the regular fitting position. For example, if fitting onto the connector I is started with the partner connector II being shifted to the Y1 side (the right side in FIG. 2) from the regular position in the connector width direction Y, the movable housing 20 of the connector I receives force toward the Y1 side from the partner housing 50, and moves to the Y1 side relative to the fixed housings 10 due to elastic displacement (elastic deformation) of the elastic portions 33 of the terminals 30. That is, due to elastic displacement of the elastic portions 33, the position shift of the partner connector II is absorbed. In this state, in FIG. 3A, the elastic portions 33 of the terminals 30 on the Y1 side are elastically displaced and compressed in the connector width direction Y, and the elastic portions 33 of the terminals 30 on the Y2 side are elastically displaced and expanded in the connector width direction Y. As described above, even when the partner connector II is fitted at the position shifted from the regular position, if a shift amount is within an acceptable amount range, such shift can be handled by elastic displacement of the elastic portions 33.

Figure 4:
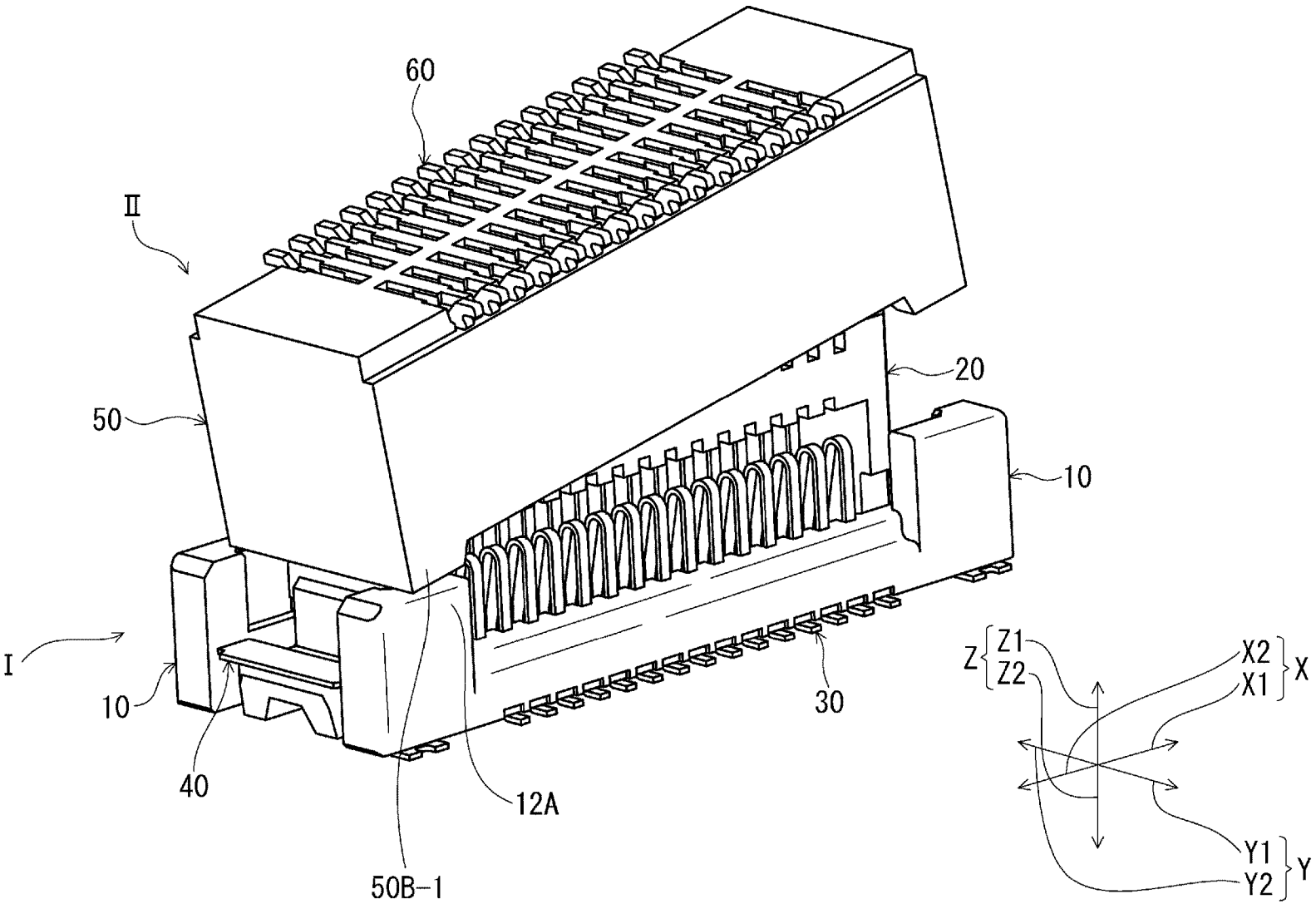
FIG. 4 is a perspective view of the connector and the partner connector of FIG. 1 in the course of detaching the partner connector in an inclined posture.
Figure 5B:
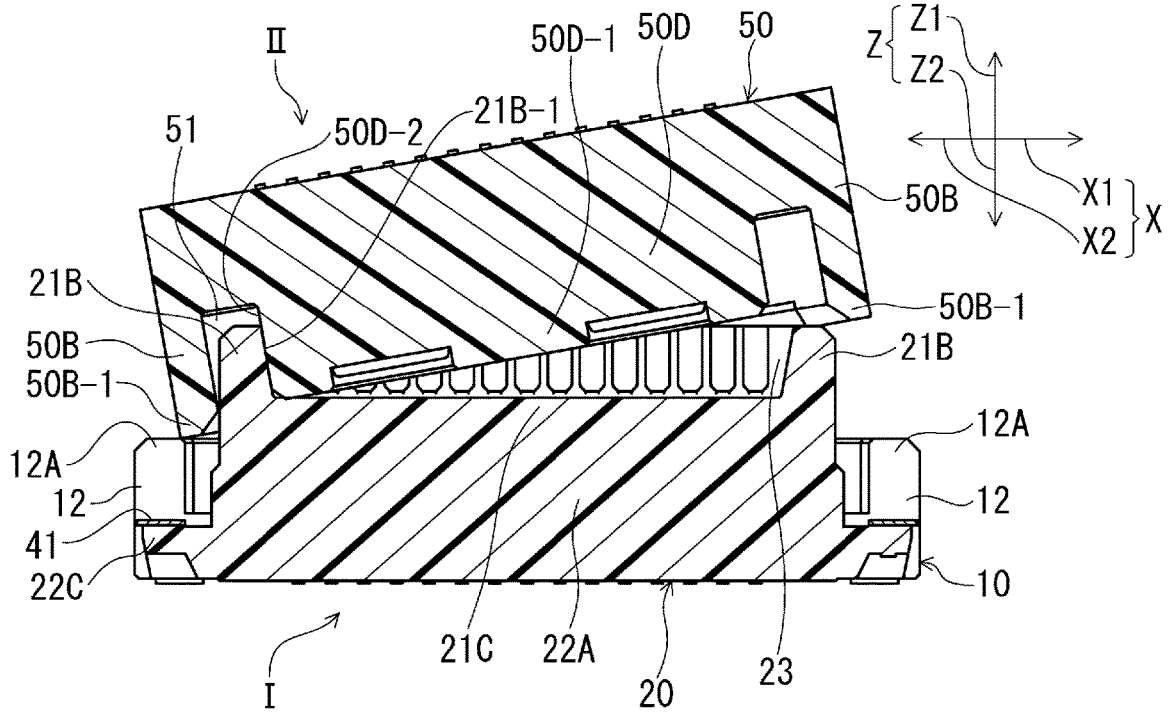

When the partner connector II fitted onto the connector I is detached from the connector I, the partner connector II can be detached in such a manner that the partner connector II is pulled straight up to the upper Z1 side without inclining with respect to the upper-lower direction Z. However, the partner connector II is detached with the partner connector II being inclined with respect to the upper-lower direction Z in some cases. In this state, as shown in FIGS. 4 and 5B, the partner connector II is inclined about the axis extending in the connector width direction Y in many cases. FIGS. 4 and 5B show a state in which a portion (a portion on the X1 side) of the partner connector II on one side in the terminal array direction X is greatly lifted with respect to a portion (a portion on the X2 side) on the other side.

Typically, when an attempt is made to detach the partner connector from the connector with the partner connector being inclined as described above, contact force in the terminal array direction greatly acts, on the other end side in the terminal array direction, between the connector end wall and the partner connector end wall. Normally, the end wall in the terminal array direction is often formed thin due to a demand for connector diameter reduction. In this case, there is a probability that the end wall is damaged by the contact force.

In the present embodiment, as shown in FIG. 5A, when the partner connector II is fitted onto the connector I at the regular fitting position, the partner connector II is not inclined with respect to the upper-lower direction Z, and a clearance a in the terminal array direction X is formed between an end surface 50D-2 of the center wall 50D of the partner connector II and the inclined surface 21B-1 of the end wall 21B of the connector I. Upon detachment of the partner connector II, when the partner connector II is inclined such that the one-end-side inclination restriction target portion 50B-1 of the partner connector II is, on one end side (the X1 side) in the terminal array direction X, lifted from the one-end-side inclination restriction portion 12A of the connector I, inclination of the partner connector II is allowed by the clearance a as shown in FIG. 5B.

When the partner connector II is in a posture inclined with the predetermined angle, the other-end-side inclination restriction target portion 50B-1 of the end wall 50B contacts, on the other end side (the X2 side) in the terminal array direction X, the other-end-side inclination restriction portion 12A of the connector I from above as shown in FIG. 5B, and accordingly, inclination with the inclination angle greater than the predetermined angle is restricted. In the present embodiment, the end surface 50D-2 of the center wall 50D of the partner connector II contacts, on the other end side (the X2 side) in the terminal array direction X, the inclined surface 21B-1 of the end wall 21B of the connector I at the same time as contact of the other-end-side inclination restriction target portion 50B-1 with the other-end-side inclination restriction portion 12A, as shown in FIG. 5B. That is, in the present embodiment, inclination of the partner connector II is also restricted by contact between the end surface 50D-2 of the center wall 50D and the inclined surface 21B-1 of the end wall 21B. In a state in which the other-end-side inclination restriction target portion 50B-1 contacts the other-end-side inclination restriction portion 12A of the connector I, the partner connector II is detached from the connector I on one end side (the X1 side). Thereafter, the partner connector II is easily detached in such a manner the partner connector II is lifted straight up to the upper Z1 side.

In the present embodiment, inclination of the partner connector II with the angle greater than the predetermined angle is, as described above, restricted by contact of the other-end-side inclination restriction target portion 50B-1 with the other-end-side inclination restriction portion 12A from above. Thus, contact force between the other-end-side inclination restriction target portion 50B-1 and the other-end-side inclination restriction portion 12A is generated in the upper-lower direction Z. Each of the coupling target portion 12 formed with the other-end-side inclination restriction portion 12A at the connector I and the end wall 50B formed with the other-end-side inclination restriction target portion 50B-1 at the partner connector II has a greater dimension in the upper-lower direction Z than the dimension in the terminal array direction X, and has a high strength. Thus, the other-end-side inclination restriction portion 12A and the other-end-side inclination restriction target portion 50B-1 can sufficiently resist the contact force in the upper-lower direction Z, and as a result, damage of the housing due to the contact force is reduced.

In the present embodiment, as shown in FIGS. 5A and 5B, the inclination restriction portions 12A of the connector I are positioned outside the end walls 50B of the partner connector II in the terminal array direction X. Thus, when the partner connector II is inclined, the other-end-side inclination restriction target portion 50B-1 of the partner connector II is, in the terminal array direction X, easily positioned within the area defined by the other-end-side inclination restriction portion 12A. Thus, inclination of the partner connector II can be favorably restricted by the other-end-side inclination restriction target portion 50B-1.

In the present embodiment, the inclination restriction portions 12A are formed at the fixed housing 10, but may be formed at the movable housing instead. Moreover, in the present embodiment, the terminals 30 are held by the fixed housings 10 and the movable housing 20, and the inclination restriction portions 12A are formed at the fixed housing 10. Instead, the housing holding the terminals and the housing having the inclination restriction portions can be provided as separate members. That is, in the case of employing such a configuration, the housing has, in addition to the fixed housings and the movable housing holding the terminals, a housing member as an independent member formed with the inclination restriction portions, for example.

The present embodiment has described that the housing of the connector I is in the so-called floatable form in which the housing of the connector I is separated into the fixed housings 10 and the movable housing 20, but the present disclosure is not limited to such a form and a single-housing form may be employed. The terminal array wall of the housing is not necessarily the side wall 21A of the housing as described in the present embodiment. For example, the terminal array wall of the housing may be a center standing wall positioned in the peripheral wall or a standing wall not surrounded by the peripheral wall. The number of terminal array walls may be a single number or a plural number.

In the present embodiment, the inclination restriction portions 12A are formed as part of the fixed housing 10 of the connector I, but instead, may be formed at another member attached to the housing, such as a metal fitting. The same also applies to a case where the connector I is in the single-housing form in which the housing of the connector I is not separated into the fixed housings and the movable housing. In the case of forming the inclination restriction portions at the metal fitting, the strength of the inclination restriction portion is higher than that in the case of forming the inclination restriction portion at resin as a general housing material, and therefore, inclination of the partner connector can be more favorably restricted. The same also applies to the form in which the housing of the connector is not separated into the fixed housings and the movable housing.

In the present embodiment, the insertion/detachment direction restriction portions and the inclination restriction portions are provided at the connector I as the receptacle connector, and the insertion/detachment direction restriction target portions and the inclination restriction target portions are provided at the partner connector II as the plug connector. However, the form of the connector provided with each portion is not limited to above. For example, the insertion/detachment direction restriction portions and the inclination restriction portions may be provided at the plug connector, and the insertion/detachment direction restriction target portions and the inclination restriction target portions may be provided at the receptacle connector.

The present embodiment has described the case where the partner connector II is, upon detachment thereof, inclined such that the end portion of the partner connector II on the X1 side in the terminal array direction X is lifted, but the present disclosure is not limited to such a case. In a case where the partner connector II is inclined such that the end portion of the partner connector II on the X2 side is lifted, the X2 side is one end side, and the X1 side is the other end side. In this case, inclination of the partner connector II with the angle greater than the predetermined angle is restricted in a manner similar to that of the contents described in the present embodiment.

In the present embodiment, the inclined surface 21B-1 of the end wall 21B of the connector I is formed with such an inclination angle (the angle of inclination with respect to the upper-lower direction Z) that the end surface 50D-2 of the center wall 50D of the partner connector II contacts the inclined surface 21B-1 at the same time as contact of the inclination restriction target portion 50B-1 of the partner connector II in the inclined posture with the inclination restriction portion 12A of the connector I. However, the angle of the inclined surface 21B-1 may be a greater inclination angle. In the case of forming the inclined surface 21B-1 with such a great inclination angle, when the inclination restriction target portion 50B-1 of the partner connector II contacts the inclination restriction portion 12A of the connector I, the end surface 50D-2 of the center wall 50D of the partner connector II does not contact the inclined surface 21B-1 of the end wall of the connector I, and a clearance in the terminal array direction X is formed between the end surface 50D-2 and the inclined surface 21B-1. That is, in this case, inclination of the partner connector II with the angle greater than the predetermined angle is restricted only by the inclination restriction portions 12A of the connector I, and is not restricted by the inclined surfaces 21B-1.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A connector attached to a circuit board, a partner connector being inserted into or detached from the connector in a connector insertion/detachment direction which is a direction perpendicular to a mounting surface of the circuit board, comprising:

a connection portion to be mounted on the mounting surface of the circuit board by soldering;

a terminal formed with a contact portion to be connected to the partner connector; and a housing holding the terminal arrayed in a terminal array direction which is a direction parallel with the mounting surface of the circuit board, wherein the housing has a terminal array wall holding the arrayed terminal, an insertion/detachment direction restriction portion provided in an area defined by the terminal array wall in the terminal array direction and configured to contact the partner connector in the connector insertion/detachment direction to set a maximum depth position of the partner connector upon fitting, and an inclination restriction portion including a one-end-side inclination restriction portion positioned at one end in the terminal array direction and another-end-side inclination restriction portion positioned on the other end, the inclination restriction portion is, at a position outside the area defined by the terminal array wall in the terminal array direction, positioned with a predetermined clearance from a corresponding portion of the partner connector at the maximum depth position upon fitting in the connector insertion/detachment direction, upon detachment of the partner connector, when the partner connector is inclined such that a one-end-side portion of the partner connector in the terminal array direction is lifted in the connector insertion/detachment direction from the one-end-side inclination restriction portion with respect to another-end-side portion of the partner connector, the other-end-side portion of the partner connector contacts the other-end-side inclination restriction portion in the connector insertion/detachment direction to restrict inclination of the partner connector with an angle greater than a predetermined angle, and the other-end-side portion of the partner connector contacts the other-end-side inclination restriction portion in the connector insertion/detachment direction only at a time when the partner connector is inclined to the predetermined angle.

2. The connector according to claim 1, wherein the housing has two terminal array walls parallel with each other, two end walls connecting end portions of the two terminal array walls on both end sides, a peripheral wall formed of the two terminal array walls and the two end walls, and a receiving space for receiving the partner connector in the peripheral wall, an inner wall surface of each of the two end walls is inclined such that a distance between the two inner wall surfaces of the two end walls increases toward the partner connector in the connector insertion/detachment direction, and the inclined surface allows the partner connector to incline until contacting the inclination restriction portion.

3. The connector according to claim 1, wherein the inclination restriction portion is positioned outside the partner connector in the terminal array direction.

4. The connector according to claim 1, wherein the inclination restriction portion is formed at a member attached to the housing.

5. The connector according to claim 1, wherein the inclination restriction portion is formed at a metal fitting as a member attached to the housing.

6. A connector assembly comprising:

the connector according to claim 1; and a partner connector fittably connected to the connector, wherein the partner connector has an inclination restriction target portion facing the inclination restriction portion of the connector in a connector insertion/detachment direction.

7. The connector according to claim 1, wherein when the partner connector is inserted into the connector, the one-end-side portion of the partner connecter is apart from the one-end-side inclination restriction portion with the predetermined clearance in the connector insertion/detachment direction, and the other-end-side portion of the partner connecter is apart from the other-end-side inclination restriction portion with the predetermined clearance in the connector insertion/detachment direction.

8. The connector according to claim 1, wherein when the partner connector is inserted into the connector, the one-end-side portion of the partner connecter does not contact the one-end-side inclination restriction portion with the predetermined clearance in the connector insertion/detachment direction, and the other-end-side portion of the partner connecter does not contact the other-end-side inclination restriction portion with the predetermined clearance in the connector insertion/detachment direction.

9. The connector according to claim 2, wherein the partner connector comprises a center wall that is inserted between the two end walls of the housing of the connector when the partner connector is inserted into the connector, the center wall comprising an end surface in parallel to the connector insertion/detachment direction, and the inner wall surface of the end wall has an inclination angle with respect to the connector insertion/detachment direction such that the end surface of the center wall of the partner connector contacts the inner wall surface at a same time as the other-end-side portion of the partner connector contacts the other-end-side inclination restriction portion in the connector insertion/detachment direction.

* * * * *